US006557211B2

(12) United States Patent
Salice

(10) Patent No.: US 6,557,211 B2
(45) Date of Patent: May 6, 2003

(54) FASTENING PLATE TO FASTEN A HINGE ARM OF A FURNITURE HINGE

(75) Inventor: Luciano Salice, Carimate (IT)

(73) Assignee: Arturo Salice S.p.A., Novedrate/Como (IT)

( * ) Notice: Subject to any disclaimer, the term of this patent is extended or adjusted under 35 U.S.C. 154(b) by 0 days.

(21) Appl. No.: 09/863,377

(22) Filed: May 24, 2001

(65) Prior Publication Data

US 2001/0044987 A1 Nov. 29, 2001

(30) Foreign Application Priority Data

May 24, 2000 (DE) ..... 200 09 316 U

(51) Int. Cl.[7] ..... E05D 5/00

(52) U.S. Cl. ..... 16/382; 16/240; 16/237; 16/242

(58) Field of Search ..... 16/240, 382, 342, 16/235, 237, 242, 362

(56) References Cited

U.S. PATENT DOCUMENTS 4,785,497 A * 11/1988 Salice ..... 16/237
5,210,907 A * 5/1993 Toyama ..... 16/251
5,251,347 A * 10/1993 Hopper et al. ..... 5/284
6,145,164 A * 11/2000 Ferrari et al. ..... 16/235
6,279,200 B1 * 8/2001 Ferrari et al. ..... 16/332
6,339,864 B1 * 1/2002 Albrecht et al. ..... 16/246
6,418,589 B1 7/2002 Salice ..... 16/258

FOREIGN PATENT DOCUMENTS

| | | |
|---|---|---|
| DE | 26 24 453 | 12/1977 |
| DE | 35 01 048 | 7/1986 |
| DE | 36 04 984 | 8/1987 |
| DE | 94 09 459 | 9/1994 |
| DE | 297 13 984 | 11/1997 |

* cited by examiner

*Primary Examiner*—Anthony Knight
*Assistant Examiner*—Mark Williams
(74) *Attorney, Agent, or Firm*—Jacobson Holman PLLC

(57) ABSTRACT

The invention relates to a fastening plate to fasten a hinge arm of a furniture hinge to a carrier wall consisting of an elongated base plate having at least two boreholes to receive fastening elements, of a cover plate covering the base plate at least in part and being guided in a transversely displaceable manner thereon, and of an eccentric to displace the cover plate with respect to the base plate. In accordance with the invention, the base plate has in the region of its boreholes, which serve to receive fastening elements, collar-like edges which connect to tang-like extensions. The collar-like edges penetrate elongate apertures provided in the cover plate and the tang-like extensions are bent down with respect to the collar-like edges so that they overhand the lateral edges of the elongate apertures.

17 Claims, 3 Drawing Sheets

FASTENING PLATE TO FASTEN A HINGE ARM OF A FURNITURE HINGE

BACKGROUND OF THE INVENTION

1. Field of the Invention

The invention relates to a fastening plate to fasten a hinge arm of a furniture hinge having an elongated base plate with at least two boreholes to receive fastening elements, a cover plate covering the base plate at least in part and being guided in a transversely displaceable manner thereon, and an eccentric to displace the cover plate with respect to the base plate.

2. Description of the Related Art

A generic fastening plate to fasten a hinge arm of a furniture hinge to a carrying wall is already known from DE 94 09 459 U. This consists of an elongated base plate having at least two boreholes to receive fastening elements, a cover plate covering the base plate at least in part and being guided in a transversely displaceable manner thereon and an eccentric to displace the cover plate with respect to the base plate. As the fastening screw for the hinge arm is located in the central region of the cover plate in this embodiment, the eccentric is offset and accessibly arranged by an appropriately arranged recess of the hinge arm. A symmetrical mounting of the fastening plate is thus not possible.

In the fastening plates known from DE 36 04 984 A, the heads of the screwed fastening screws are supported on the projections of the base plate penetrating the elongate apertures of the cover plate. A third clamping screw to be provided especially for this purpose serves to fix the cover plate. Alternatively, the clamping can be carried out by one of the fastening screws itself with a corresponding dimensioning.

In the fastening plates known from DE 297 13 984 U, no base plate is present. The cover plate is fixed by the fastening screws here so that a vertical adjustment by an eccentric is generally not possible.

SUMMARY OF THE INVENTION

It is the object of the present invention to provide a fastening plate as a symmetrical cross-mounting plate made of steel which allows a simple vertical adjustment of clip hinges adjustable by an eccentric, with a low-cost manufacture of the fastening plate being made possible and with the single components of the fastening plate not having any complex back cuts or undercuts which make mounting unnecessarily difficult.

This object is solved in accordance with the present invention by a fastening plate having an elongated base plate with at least two boreholes to receive fastening elements, a cover plate covering the base plate at least in part and being guided in a transversely displaceable manner thereon, and an eccentric to displace the cover plate with respect to the base plate. The base plate has, in the region of its boreholes serving to receive fastening elements, collar-like edges to which tang-like extensions connect. The collar-like edges penetrate elongate apertures provided in the cover plate. The tang-like extensions are bent down with respect to the collar-like edges such that they overhang the lateral edges of the elongate apertures associated therewith.

Preferred embodiments of the invention can be found in the dependent claims.

For instance, the shaft of the eccentric can penetrate a central longitudinally directed elongate aperture, whose width corresponds to the shaft diameter, in the web part of the cover plate and its lower, eccentric shaft part of a lower diameter can be pivoted in a central borehole of the base plate.

In addition, the width of the elongate apertures in the cover plate may correspond to the diameter of the collar-like edges of the boreholes, and the cover plate may be displaceably guided along the base plate via lateral edges. The end regions of the cover plate may be provided with lateral web parts which serve to anchor an attachable hinge arm.

The fastening plate according to the present invention may further include slots molded in the cover plate which serve to receive wedge-shaped extensions which are molded directly on the furniture hinge to be fastened or to an intermediate plate connected thereto. Additionally, the eccentric may have a screw head which can be actuated by corresponding slots in the attached hinge arm and, optionally, in the intermediate plate provided. The base plate and/or the cover plate may be designed to be symmetrical to their longitudinal and transverse central axes.

The fastening plate in accordance with the invention can particularly advantageously be manufactured in a method in which the tang-like extensions are bent down during the putting together of the components.

Further details and advantages of the invention can be seen in an embodiment shown in the drawing, which shows:

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
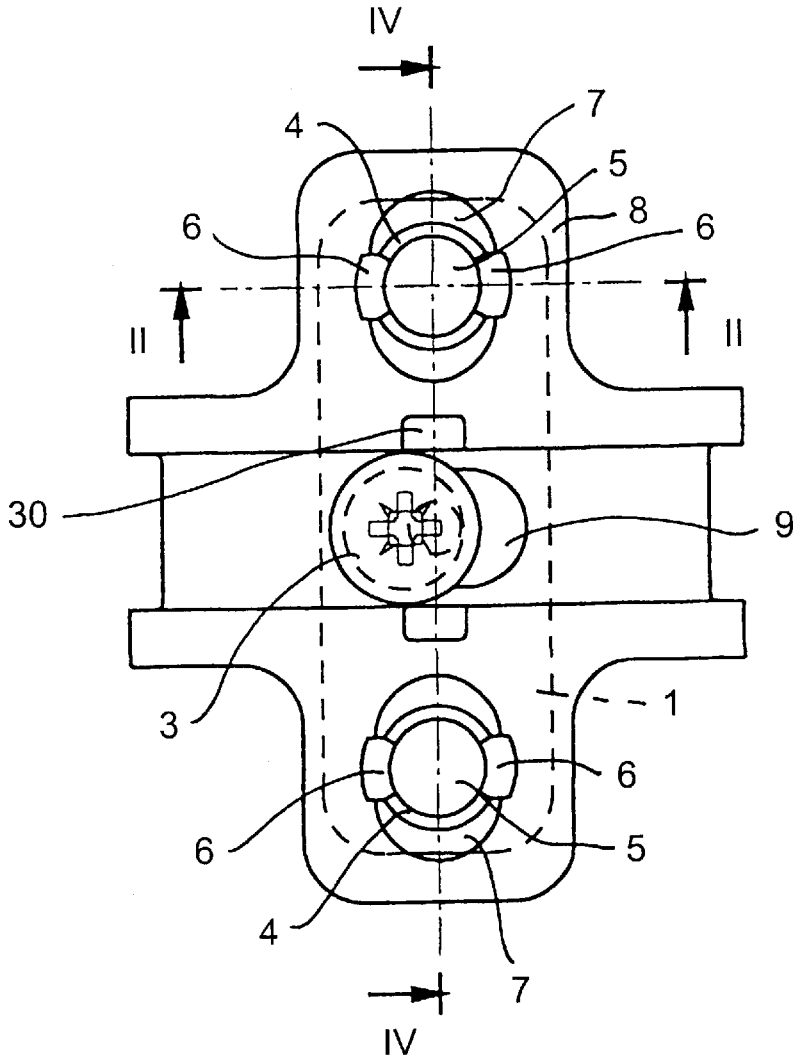
FIG. 1 a plan view of an embodiment of the fastening plate in accordance with the invention.
Figure 2:
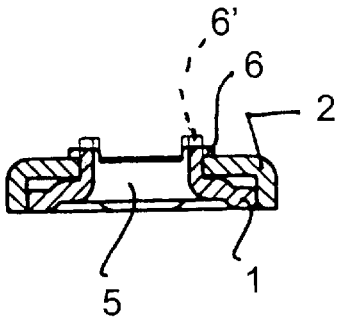
FIG. 2 a section in accordance with the section line II—II in FIG. 1.

The fastening plate shown in the FIGS. 1 to 4 essentially consists of a base plate 1, a cover plate 2 and an eccentric 3. The simple manufacturing and mounting method based on the invention can be explained in particular by means of FIG. 4. The base plate 1, which has an essentially elongated rectangular shape, is provided in the region of its ends with fastening boreholes 5 surrounded by collar-like edges 4. The collar-like edges 4 have projecting tangs 6 at the regions directed to the longer sides of the base plate 1. Elongate apertures 7 are arranged in lateral extensions 8 on an imagined connecting line in the cover plate 2. The tangs 6 starting at the collar-like edges project in the mounted state beyond the cover plate, as is shown in FIG. 2 with a thinner line with reference to the reference numeral 6'. When the cover plate 2 is put together with the base plate 1, the tangs 6' are bend down outwardly with respect to the edges 4 so that they overhang the lateral edges of the elongate apertures 7 and so form undercuts which ensure a secure hold of the cover plate with respect to the base plate and an easy-moving guidance of the cover plate in the base plate.

The eccentric 3 is inserted into a central elongate aperture 9 of the cover plate 2 such that its shaft 10 is located between the edges of the elongate aperture 9. An eccentric shaft 11 with a smaller diameter connected to the shaft 10, penetrates a centrally arranged borehole 12 in the base plate 1 and is rotatably connected thereto by the forming of a rivet.

Figure 3:
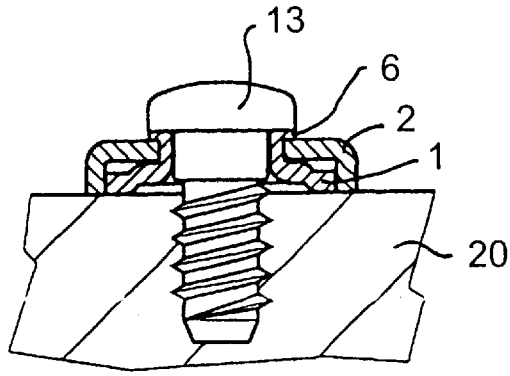
FIG. 3 the fastening plate shown in FIG. 2 in mounted form, with the fastening plate cut.
Figure 4:
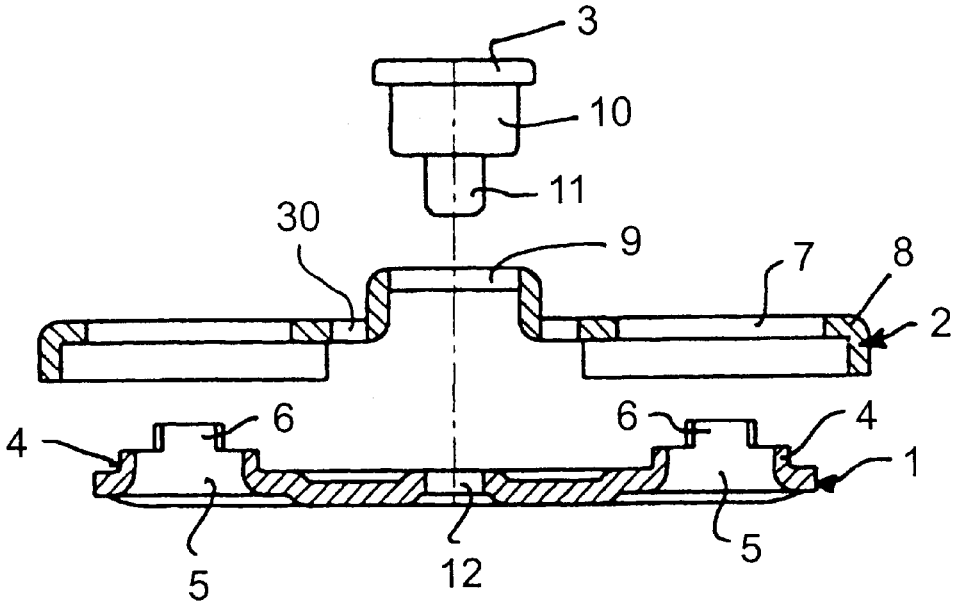
FIG. 4 a section in accordance with the section line IV—IV in FIG. 1.
Figure 5:
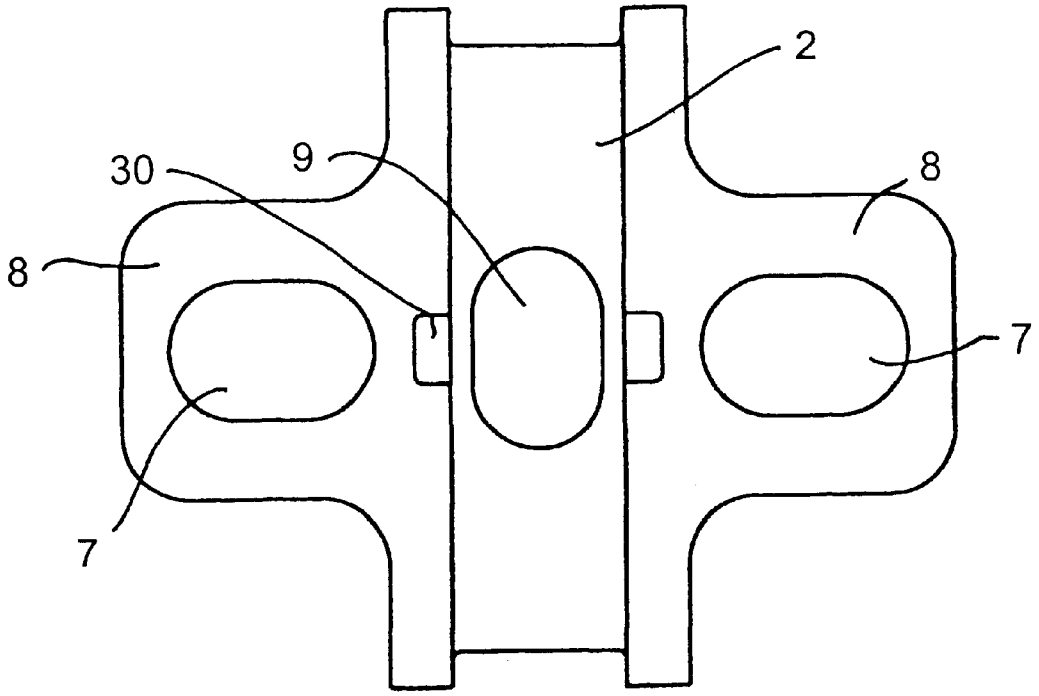
FIG. 5 a plan view of the cover plate in accordance with the embodiment of FIG. 1.
Figure 6:
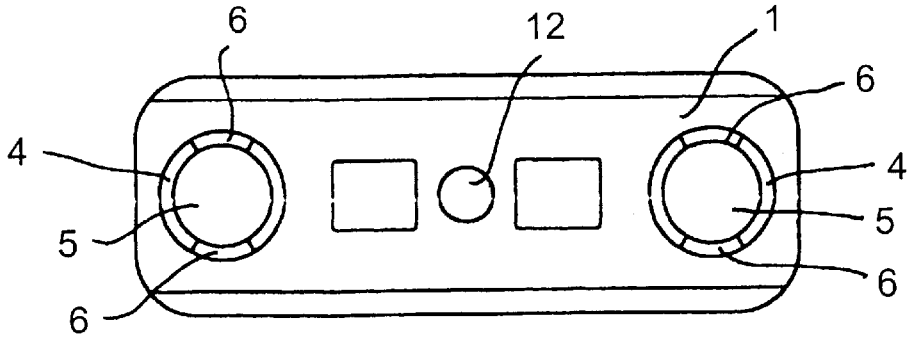
FIG. 6 a plan view of the base plate in accordance with the embodiment of FIG. 1 before it is mounted.

It can be seen from FIG. 3 that heads 13 of the fastening screws are supported at the tangs 6 in the mounted state of the fastening plate so that they support the collar-like edge which is formed by the bent tangs and amplify their holding force. The intermediate space formed by the bending of the tangs 6 is, however, dimensioned such that the cover plate 2 can be displaced with respect to the base plate 1 during any vertical adjustment which is achieved due to the actuation of the eccentric 3. Appropriately, the width of the elongate apertures 7 corresponds to the diameter of the collar-like edges 4 of the fastening boreholes 5. The cover plate 2, however, can additionally be guided through the edges formed at the extensions 8 and abutting the side surfaces of the base plate 1.

Figure 7:
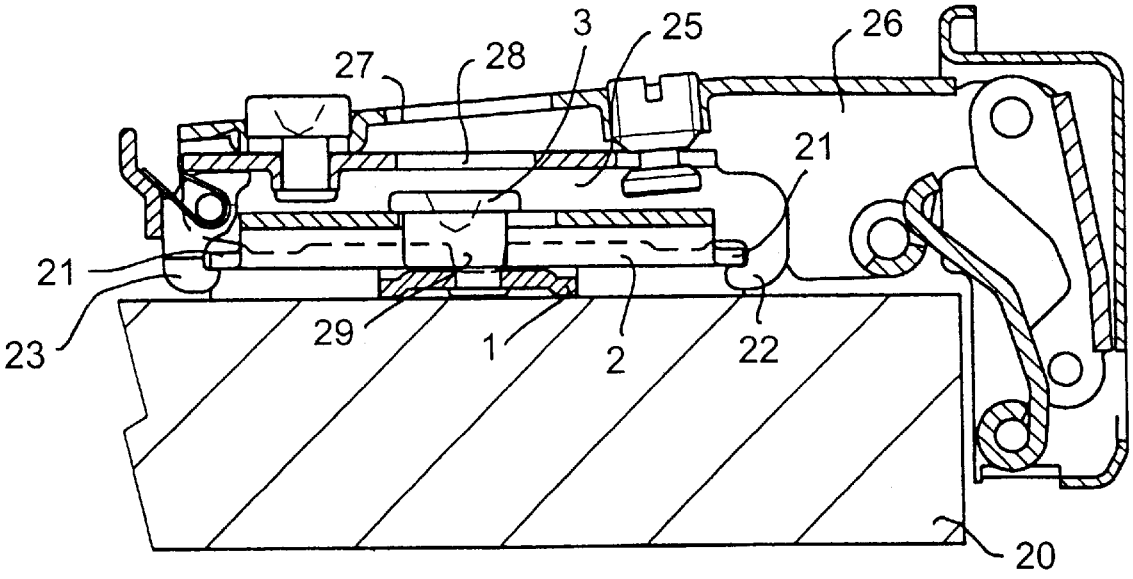
FIG. 7 a sectional representation of the fastening plate in accordance with FIG. 1 with an attached hinge arm of a furniture hinge mounted in a carrier wall.

The fastening plate fastened on a body side wall 20 is shown with a mounted clip hinge 26 in FIG. 7. The structure of the clip hinge is not looked at in any further detail here since it is known per se in the prior art. Reference is only made here to the fact that the end regions of the cover plate are provided with lateral web parts 21 which serve the anchoring of both the front hooks 22 of an intermediate plate 25 of the hinge arm 26 and of a rear latch lever 23.

The cover plate 2 is furthermore provided with slots 30 which serve in the mounted state to receive wedge-shaped extensions 29 provided centrally on the walls of the intermediate plate 25.

The eccentric 3 can have a screw head which can be actuated by a screwdriver by slots 27 and 28 provided in the web part of the hinge arm 26 and the intermediate plate 25.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A fastening plate to fasten a hinge arm of a furniture hinge to a carrier wall comprising:

an elongated base plate having at least two boreholes to receive fastening elements;

a cover plate covering the base plate at least in part and being guided in a transversely displaceable manner thereon; and an eccentric to displace the cover plate with respect to the base plate;

said boreholes of said base plate having collar-like edges to which tang-like extensions connect, said collar-like edges penetrating elongate apertures provided in the cover plate with the tang-like extensions bent down with respect to the collar-like edges so as to overhang lateral edges of the elongate apertures and thereby being adapted to contact an underside of said fastening elements.

2. The fastening plate in accordance with claim 1, wherein the eccentric has a shaft that penetrates a central elongate aperture oriented in the longitudinal direction of the cover plate, a width of said elongate aperture corresponding to the diameter of the shaft, said eccentric further having an eccentric shaft part below the shaft which has a lesser diameter than the shaft, said eccentric shaft part being pivoted in a borehole centrally arranged in the base plate.

3. The fastening plate in accordance with claim 1, wherein a width of the elongate apertures corresponds to a diameter of the collar-like edges of the boreholes.

4. The fastening plate in accordance with claim 1, wherein the cover plate is displaceably guided along the base plate via said lateral edges.

5. The fastening plate in accordance with claim 1, wherein end regions of the cover plate are provided with lateral web parts which serve to anchor an attachable hinge arm.

6. The fastening plate in accordance with claim 1, wherein slots are moulded in the cover plate which serve to receive wedge-shaped extensions which are moulded on a furniture hinge to be fastened.

7. The fastening plate in accordance with claim 1, wherein the eccentric has a screw head which can be actuated by corresponding slots in an attached hinge arm.

8. The fastening plate in accordance with claim 1, wherein at least one of the base plate and the cover plate are designed symmetrically to their respective longitudinal and transverse central axes.

9. A fastening device to fasten a hinge arm of a furniture hinge to a carrier wall comprising:

an elongated base plate with at least two boreholes having collar-like edges from which extensions project;

a cover plate having at least two elongate apertures spaced to be in respective alignment with said boreholes and penetrated by said collar-like edges, said extensions bent down with respect to the collar-like edges so as to overhang lateral edges of the elongate apertures such that said cover plate is guided in a transversely displaceable manner on said base plate;

an eccentric to displace the cover plate with respect to the base plate; and at least two fastening elements for engaging with said boreholes such that heads of said fastening elements contact and support said bent down extensions to amplify a holding force thereof.

10. The fastening plate in accordance with claim 9, wherein said extensions are tang-like portions.

11. The fastening plate in accordance with claim 9, wherein the eccentric has a shaft that penetrates a central elongate aperture oriented in the longitudinal direction of the cover plate, a width of said elongate aperture corresponding to the diameter of the shaft, said eccentric further having an eccentric shaft part below the shaft which has a lesser diameter than the shaft, said eccentric shaft part being pivoted in a borehole centrally arranged in the base plate.

12. The fastening plate in accordance with claim 9, wherein a width of the elongate apertures corresponds to a diameter of the collar-like edges of the boreholes.

13. The fastening plate in accordance with claim 9, wherein the cover plate is displaceably guided along the base plate via said lateral edges.

14. The fastening plate in accordance with claim 9, wherein end regions of the cover plate are provided with lateral web parts which serve to anchor an attachable hinge arm.

15. The fastening plate in accordance with claim 9, wherein slots are moulded in the cover plate which serve to receive wedge-shaped extensions which are moulded on a furniture hinge to be fastened.

16. The fastening plate in accordance with claim 9, wherein the eccentric has a screw head which can be actuated by corresponding slots in an attached hinge arm.

17. The fastening plate in accordance with claim 9, wherein at least one of the base plate and the cover plate are designed symmetrically to their respective longitudinal and transverse central axes.

* * * * *